US007015813B1

(12) United States Patent
Loster

(10) Patent No.: US 7,015,813 B1
(45) Date of Patent: Mar. 21, 2006

(54) DEVICE FOR CONTROLLING THE HOOKING OF TWO SHEET PILE LOCKS

(75) Inventor: Peter Loster, Mitterfels (DE)

(73) Assignee: Ar Celor RPS Sarl, Esch-sur-Alzette (LU)

( * ) Notice: Subject to any disclaimer, the term of this patent is extended or adjusted under 35 U.S.C. 154(b) by 742 days.

(21) Appl. No.: 10/030,607

(22) PCT Filed: Jul. 7, 2000

(86) PCT No.: PCT/EP00/06484

§ 371 (c)(1),
(2), (4) Date: May 1, 2002

(87) PCT Pub. No.: WO01/04423

PCT Pub. Date: Jan. 18, 2001

(30) Foreign Application Priority Data

Jul. 9, 1999 (DE) ..... 199 31 977

(51) Int. Cl.
*G08B 13/14* (2006.01)

(52) U.S. Cl. ..... 340/568.1; 405/278; 405/281

(58) Field of Classification Search ..... 340/568.1; 405/20, 85, 107, 278, 281
See application file for complete search history.

(56) References Cited

U.S. PATENT DOCUMENTS

| | | | | |
|---|---|---|---|---|
| 3,803,577 | A | 4/1974 | Peterson, II | 340/280 |
| 4,981,540 | A * | 1/1991 | Prochhorst | 156/157 |
| 6,282,762 | B1 * | 9/2001 | Wall | 24/573.09 |
| 6,758,634 | B1 * | 7/2004 | Nickelson et al. | 405/129.55 |

FOREIGN PATENT DOCUMENTS

| | | |
|---|---|---|
| EP | 0 141 463 | 5/1985 |
| FR | 2 646 188 | 10/1990 |
| NL | 7908262 | 6/1981 |

* cited by examiner

*Primary Examiner*—Daniel Wu
*Assistant Examiner*—Samuel J. Walk
(74) *Attorney, Agent, or Firm*—Andrus, Sceales, Starke & Sawall, LLP

(57) ABSTRACT

A device for ensuring that two sheet pile locks (10, 12) are hooked correctly, comprising a detector (18) which is arranged in the locking area (14) of the first lock in such a way that a complementary lock part (16) of the second lock crosses through said detector when the sheet pile locks are hooked correctly. The inventive device also comprises an electric circuit which determines when the detector (18) has been crossed through. The electric circuit comprises a mounting (28') inside the detector. Said mounting has a first impedance value prior to the through-crossing of said detector (18) and a second impedance value after through-crossing has occurred. Both impedance values are distinctly different from the impedance value of a short circuit or an interruption in the electric circuit outside the mounting.

16 Claims, 4 Drawing Sheets

DEVICE FOR CONTROLLING THE HOOKING OF TWO SHEET PILE LOCKS

CROSS REFERENCE TO RELATED APPLICATION

The present application is the U.S. national stage application of International Application PCT/EP00/06484, filed Jul. 7, 2000, which international application was published on Jan. 18, 2001 as International Publication WO 01/04423 in the German language. The International Application claims priority of German Patent Application 199 31 977.4, filed Jul. 9, 1999.

SUMMARY OF THE INVENTION

The present invention relates to a device for controlling the hooking of two sheet pile locks, wherein the first lock comprises a locking chamber into which a complementary lock part of the second lock must penetrate to ensure correct hooking.

When driving sheet piles into difficult ground, it is important to be able to demonstrate that two sheet pile locks have been correctly hooked, that is, that a so-called "declutching" has not occurred.

A declutching detector system is known, for example, from EP 0 141 463. The detector is designed in the form of tube, which extends through the locking chamber, wherein its two ends are anchored in opposite walls of said locking chamber. Two electrically conducting signal wires are fixed inside the tube with the help of epoxy resin and short circuited at one end. These signal wires are connected to a voltage source via a connecting wire, which runs along said first lock up to the surface of the ground, so that a closed electrical circuit is formed. When the two locks are correctly hooked, said detector is sheared by the projection of the complementary lock part of the second lock penetrating into the locking chamber of the first lock. This interrupts the closed electrical circuit, which can be evaluated as proof of correct hooking. By contrast, in the case of a declutching, the projecting, complementary lock part of the second lock is no longer capable of shearing the detector in the locking chamber of the first lock. A closed electrical circuit after the driving of the second sheet pile is therefore evaluated as proof of a declutching.

However, this detector system from EP 0 141 463 presents serious drawbacks. For example, if there is a short circuit in the connecting line of the detector, an intact detector will be continuously indicated. After the second sheet pile has been driven, it must consequently be assumed that a declutching has occurred, although correct shearing of the detector may have taken place. By contrast, if an interruption in the connecting line of the detector occurs in the final phase of driving the second sheet pile, the resulting interruption of the electric circuit may be incorrectly evaluated as a "detector sheared". In both cases, an incorrect inference may be made about the state of hooking of the two sheet pile locks. In this context, it should also be noted, that short circuits and interruptions in the connecting line of the detector are relatively frequent in practice, so that with the detector system of EP 0 141 463, the risk of incorrect inferences regarding the hooking of two sheet pile locks is relatively high.

BRIEF DESCRIPTION OF THE INVENTION

Consequently, the object of the present invention is to provide a device for controlling the hooking of two sheet pile locks that allows more reliable inferences. According to the invention, this object is achieved by a device according to claim 1. Further embodiments of the invention form the subject matter of the dependent claims.

The device according to the invention for controlling the hooking of two sheet pile locks comprises a detector which is arranged in the locking chamber of the first lock in such a manner that—when the two locks are correctly hooked—is sheared by the complementary lock part of the second lock. An electric circuit allows to determine the shearing of the detector. In accordance with an important aspect of the present invention, this electric circuit in the detector comprises circuitry, which presents a first impedance value before the detector is sheared and a second impedance value after the detector is sheared, wherein the two impedance values are clearly distinguished from the impedance value of a short circuit or an interruption in the electric circuit outside said circuitry. In a device according to the invention, evaluation of an electrical measurement of the circuit allows an unambiguous distinction to be made regarding whether (a) the detector in the locking chamber is still intact, or (b) whether a short circuit is present, or (c) whether the detector in the locking chamber has been sheared or (d) whether the cable has broken. An unambiguous distinction between these four cases naturally allows considerably more reliable statements to be made regarding correct hooking, respectively declutching.

In a first embodiment of the invention, the detector comprises one end made from a ferro-magnetic material, which is arranged in the locking chamber of the first lock in such a manner that when the two locks are correctly hooked, it is detached from the remainder of the detector by the complementary lock part of the second lock. The circuitry in the remainder of the detector comprises an inductive switching element, the inductivity of which is altered by the detachment of the ferromagnetic end of the detector.

In a second embodiment, the detector comprises one end with a permanent magnet, which is arranged in the locking chamber of the first sheet pile lock in such a manner that when both sheet pile locks are correctly hooked, it is detached from the remainder of the detector by the complementary lock part of the second sheet pile lock. In this embodiment, the electrical circuit in the remainder of the detector comprises a circuitry, which responds to a change in the magnetic field, which is caused by the detachment of the permanent magnet.

In both the first and also in the second embodiment, the device according to the invention has the advantage that when the detector is sheared, the electric circuitry is not exposed but remains encapsulated in the remainder of the detector, so that the risk of an adjacent short circuit in the detector is virtually excluded. As a result, this detector is also excellently suited for use in a conductive environment, e.g., salt water.

In accordance with a simple but reliable embodiment, the circuitry in the detector comprises e.g. a magnetically actuated microswitch with a parallel resistor and a series resistor. The microswitch is preferably held in open position by the magnet, so that the resistance of the circuitry is the same as the sum of the parallel resistor and the series resistor. As soon as the magnet is detached from the remainder of the detector, the magnetically actuated microswitch closes. The parallel resistor is now short circuited, so that the resistance of the circuitry is the same as the series resistor. It is of course, also conceivable to manufacture the circuitry with a microswitch which is held in closed position by the magnet.

In a third embodiment, the detector also comprises one end which is arranged in the locking chamber of the first lock in such a manner, that when the two locks are correctly hooked, it is detached from the remainder of the detector by the complementary lock part of the second lock. In this embodiment, the electric circuit in the detector comprises a resistance circuitry, which comprises a terminating resistor in the detachable end of the detector. In the remainder of the detector, the resistance circuitry comprises a first resistor and a second resistor, wherein the second resistor is connected in series with the terminating resistor, and the first resistor is connected in parallel to the series circuitry of the terminating resistor and the second resistor. This circuitry allows an unambiguous distinction to be made through a measurement of resistance regarding whether (a) the detector in the locking chamber is still intact; (b) there is a short circuit in the connecting line; (c) there is a short circuit at the shear point in the detector; (d) the detector in the locking chamber has been correctly sheared; (e) there is a broken cable in the connecting line.

Additionally, a diode may be directly connected in front of the resistance circuitry, so that a direct current can only flow through the resistance circuitry in one direction. Accordingly, by reversing the polarity of the supply voltage, it can be determined whether there is an insulation fault in the connecting line. Moreover, with this circuitry, the influence of an insulation fault on the measurement of the resistance can be compensated.

The terminating resistor in the detachable end of the detector and the resistance circuitry in the remainder of the detector are connected to one another by two electrical conductors, which are at least partly exposed after the shearing of the detector. In a conductive environment, such as salt water, a relatively low transition resistance predominates between the two exposed electrical conductors, which might suggest a short circuit at the shear point. To preclude the possibility of such a false interpretation, the two electrical conductors are advantageously designed in such a manner that they form an electrically insulating layer relatively quickly under tension in salt water. As a result, the transition resistance between the two electrical conductors increases relatively quickly, so that a short circuit at the detachment point can be precluded with certainty after a relatively brief period.

A device according to the invention comprises, by preference, a special evaluation unit which continuously measures at least one electrical parameter of the electrical circuit, and on the basis of the measured values, directly displays different operating states, or communicates the operating states for subsequent evaluation or display. This evaluation unit may be arranged completely above ground. However, it may also comprise an above-ground unit and a below-ground unit. In this context, the below-ground unit is arranged in the immediate proximity of the detector or in the detector itself. It is an active component group which continuously measures at least one electrical parameter of the electric circuit, carries out a preliminary evaluation of this measurement and, on the basis of the preliminary evaluation, sends predetermined signals (e.g. predetermined digital signals or predetermined frequency signals) to the above-ground unit. The above-ground unit then evaluates these signals from the below-ground unit and allocates to them corresponding states which are then displayed.

An evaluation unit of this kind is advantageously designed in such a manner that it checks the stability of the resistance measurement during a predetermined time after any change in resistance in the circuitry in the detector, so that, for example, the above-mentioned increase in transition resistance in a conductive environment, such as salt water, is registered. In this manner, a short circuit at the detachment point can be unambiguously distinguished, e.g. from a normal shearing of the detector in salt water.

In one device according to the invention with a connecting line, an evaluation unit of this kind preferably comprises at least displays for the following states: a) detector is OK; b) detector has been sheared; c) connecting line has been broken; d) short circuit in the connecting line. In the case of a detector circuit with exposed electrical conductors in the sheared detector, this should additionally comprise displays for a short circuit at the detachment point or for an unstable or increasing resistance measurement.

The detector is advantageously subdivided by a predetermined breaking point into a detector base and a detector head, wherein the detector base is attached to the first lock, and the detector head projects in an cantilevered manner into the locking chamber of the first lock. When the two locks are correctly hooked, the detector head will certainly be sheared from the detector base at the predetermined breaking point by the complementary lock part of the second lock.

BRIEF DESCRIPTION OF THE DRAWING

Various embodiments of the invention will now be described below with reference to the attached drawings, in which.

DETAILED DESCRIPTION OF THE INVENTION

Figure 2:
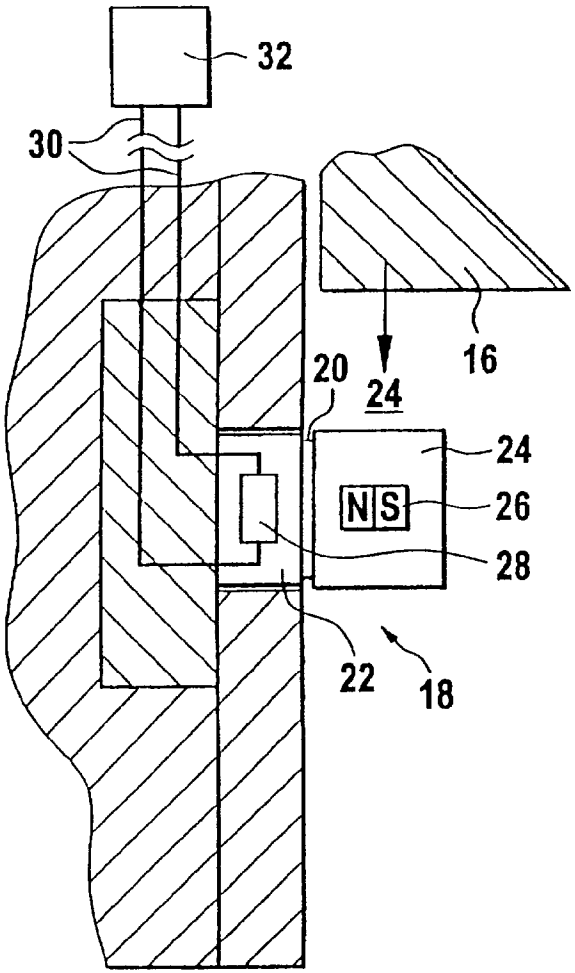
FIG. 2 shows a diagrammatic, longitudinal section through two hooked sheet pile locks with a built-in detector with permanent magnet, prior to the shearing off of the permanent magnet.
Figure 1:
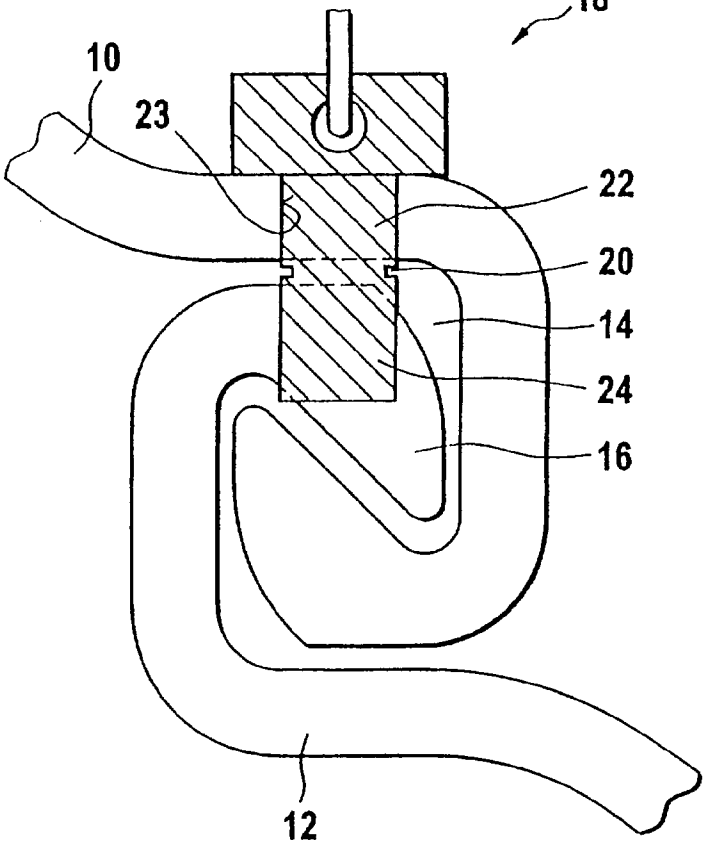
FIG. 1 shows a diagrammatic cross-section through two hooked sheet pile locks with one built-in detector, which belongs to a device according to the invention.

FIG. 1 shows two hooked sheet pile locks 10 and 12. The first lock 10 is part of a sheet pile, which has already been driven into the ground. The second lock 12 is part of a sheet pile which is in the process of being driven into the ground, wherein the first lock 10 comprises a locking chamber 14, into which the complementary lock part 16 of the second lock 12 penetrates.

Reference number 18 refers to a detector which is a component of the device according to the invention for controlling the hooking of two sheet pile locks 10 and 12 and is arranged at the lower end of the first sheet pile 10. This detector 18 comprises a pin-shaped body which is subdivided by a predetermined breaking point, which may be formed, for example, by a continuous groove 20, into a detector base 22 and a detector head 24. The detector base 22 is fixed in a lateral bore hole 23 in the first lock 10 in such a way that it projects in an cantilevered manner into the locking chamber 14 of the first lock 10. As shown in FIG. 1, the detector head 24 is arranged within the locking chamber 14 in such a manner that it will be sheared off at the predetermined breaking point 20 by the lock part 16 projecting into the locking chamber 14. However, the shearing off will occur only if the lock part 16 is guided in the locking chamber 14 as far as the detector 18. In other words, if a so-called declutching occurs, in which the lock part 16 jumps out of the locking chamber 14, the detector 18 will remain intact.

Figure 3:
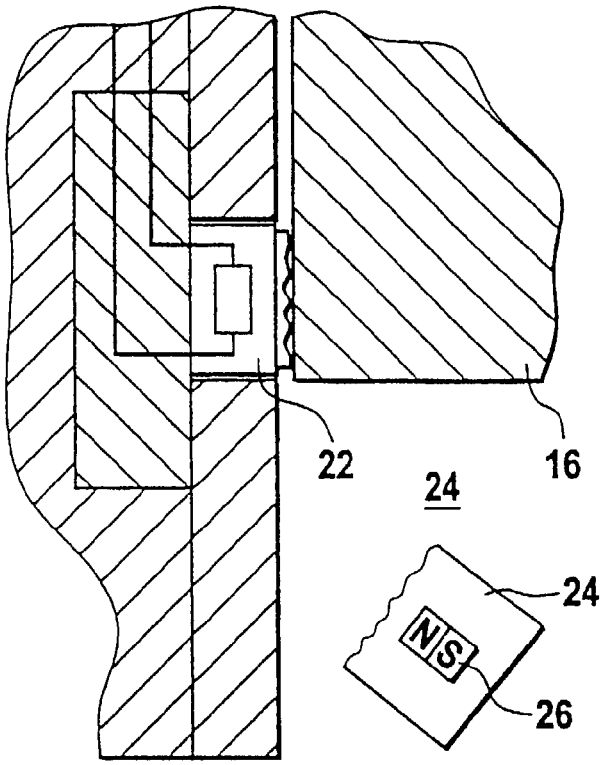
FIG. 3 shows the arrangement of FIG. 2 after the shearing of the permanent magnet.

FIGS. to 2 to 4 show a first embodiment of a detector 18 of this kind. In this embodiment, a permanent magnet 26 is arranged in the detector head 24. An electric circuitry 28 is arranged in the detector base 22, which responds to a magnetic field change, caused by the detachment of the detector head 24 with the permanent magnet 26 (see FIG. 3). A connecting line 30, which runs in a protective tube (not shown) along the lock 10 up to the upper edge of the ground, connects the circuitry 28 with an electronic evaluation unit 32 at the upper edge of the ground. However, as described above, this evaluation unit 32 could also consists of an above-ground unit and a below-ground unit.

Figure 4:
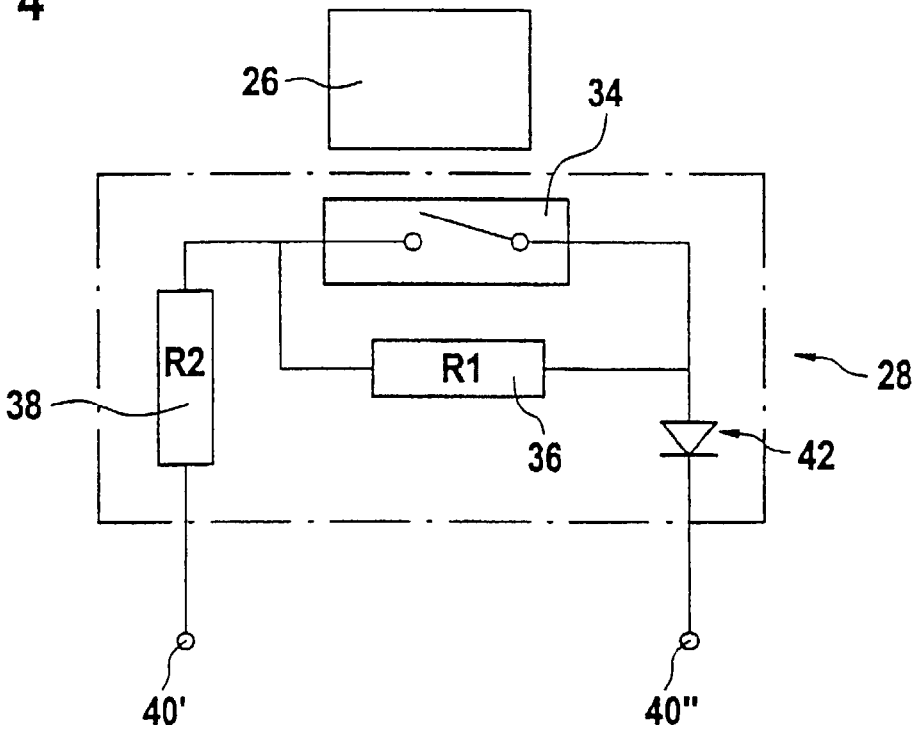
FIG. 4 shows a circuit diagram for a detector as in FIG. 2.

An advantageous embodiment of the circuitry 28 will now be described with reference to FIG. 4. It comprises a magnetically actuated microswitch 34 with a parallel resistor 36 (of resistance value R1) and a series resistor 38 (of resistance value R2). The microswitch is held, preferably in the open position, by the magnet, so that the resistance of the circuitry 28 measured at the connecting points 40', 40" is equal to the sum of R1 and R2. The first resistance value, to which the state "detector still intact" is allocated, is, in this context, significantly less than an "infinite" resistance in the case of a broken cable, and at the same time, significantly greater than a short circuit resistance in the connecting line 30, so that, by means of a resistance measurement in the evaluation unit 32, the state "detector still intact" can be unambiguously distinguished from the state "short circuit in the connecting line" or from the state "broken cable". As soon as the detector head 24 with the permanent magnet 26 is sheared off, the magnetically actuated microswitch 34 closes. The resistance R1 is now short circuited, so that the resistance of the circuitry is equal to R2. This second resistance value, to which the state "detector has been sheared" is allocated, is also significantly greater than a short-circuit resistance, however, it is also significantly less than the resistance value R1+R2, so that, by means of a resistance measurement in the evaluation unit 32, the state "detector has been sheared" can be unambiguously distinguished from the states "short circuit in the connecting line", "detector still intact" and "broken cable".

Reference number 42 refers to a diode, which is mounted in the circuitry 28 in such a manner that a direct current can only flow in one direction through the circuitry 28. As a result, a reversal of the polarity of the supply voltage can be used to determine whether an insulation fault, which could lead to incorrect evaluations, is present in the connecting line. As will be explained in greater detail in the context of FIG. 10, the resistance of the circuitry 28 can therefore be determined in spite of an insulation fault in the connecting line 30. It should be noted that in FIG. 3, i.e. after the shearing off of the detector head 24, the circuitry 28 is still correctly encapsulated in the detector base, so that the risk of an adjacent short circuit in the detector is virtually excluded, and the detector 18 also operates without problems in an electrically conductive environment, such as salt water.

Figure 5:
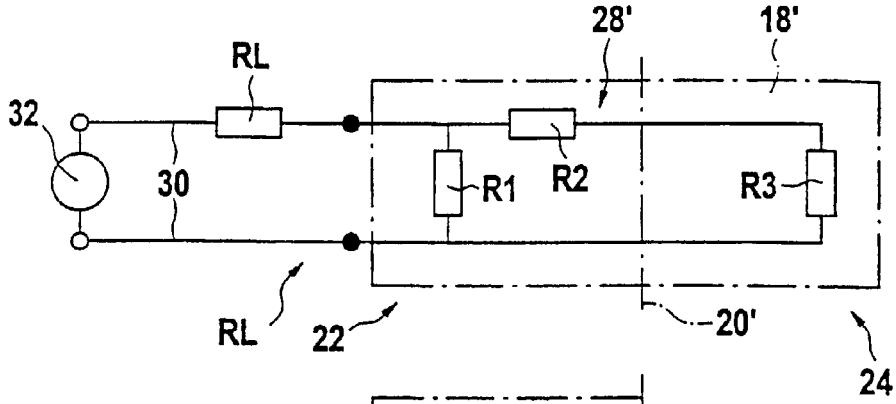
FIG. 5 shows a circuit diagram for an alternative embodiment of the detector.

A second embodiment of a detector for a device according to the invention will now be described with reference to FIGS. 5 to 9. In FIG. 5, this detector is indicated with a broken line 18'. The predetermined breaking point between the detector base 22 and the detachable detector head 24 is indicated in FIGS. 5 to 10 with a separating line 20'. With this embodiment of the detector, the electrical circuit which monitors the detector with regard to shearing, comprises a resistance circuitry 28' with three resistors R1, R2 and R3. The resistors R1 and R2 are arranged in the detector base. Resistor R3, however, is arranged as a terminating resistor in the detector head 24, which is supposed to be sheared off when the locks 10, 12 are correctly hooked.

In FIG. 5, the evaluation unit 32 measures a resistance value Ra=RL+[R1*(R2+R3)/(R1+R2+R3)], wherein RL represents the conductor resistance of the connecting line 30. The state "detector is intact" is allocated to this resistance value.

Figure 6:
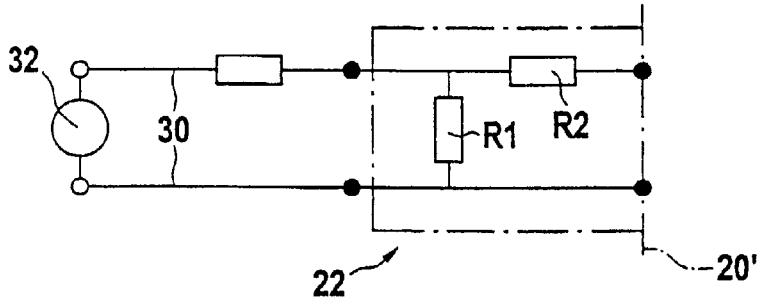
FIG. 6 shows the circuit diagram of FIG. 5 after a correct shearing of the detector.

FIG. 6 shows the detector after the shearing off of the detector head 24. The evaluation unit 32 now measures a resistance value Rb=RL+R1. The state "detector has been correctly sheared" is allocated to this resistance value.

Figure 7:
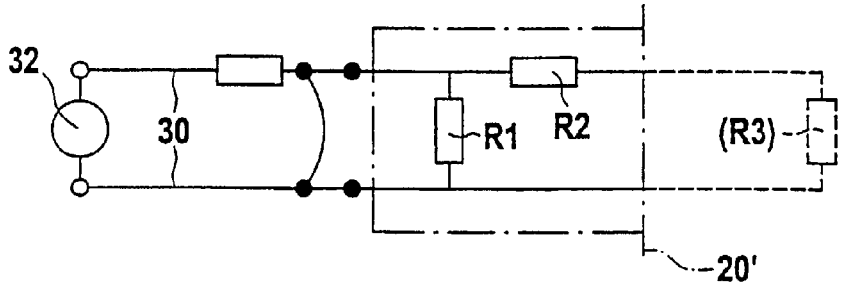
FIG. 7 shows the circuit diagram of FIG. 5 after a short circuit in a connecting line.

FIG. 7 represents a short circuit in the connecting line. In this case, the evaluation unit 32 measures a resistance value Rc=RL*, which is in the order of magnitude of the conductor resistance RL. The state "short circuit in the connecting line" is allocated to this resistance value Rc.

Figure 8:
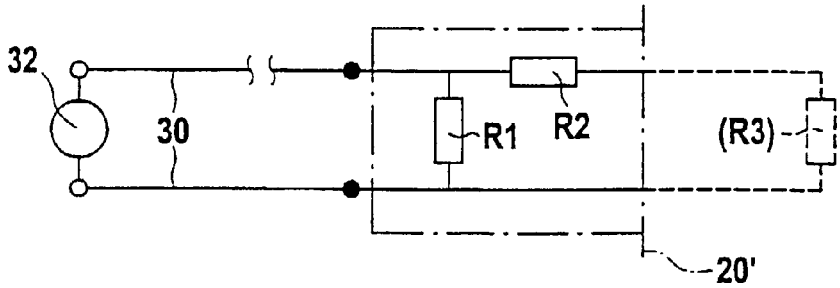
FIG. 8 shows the circuit diagram of FIG. 5 after a breaking of a wire in a connecting line.

FIG. 8 shows a break in the connecting line. The evaluation unit 32 now measures an "infinite" resistance Rd. The state "broken cable" is allocated to this resistance value Rd.

Figure 9:
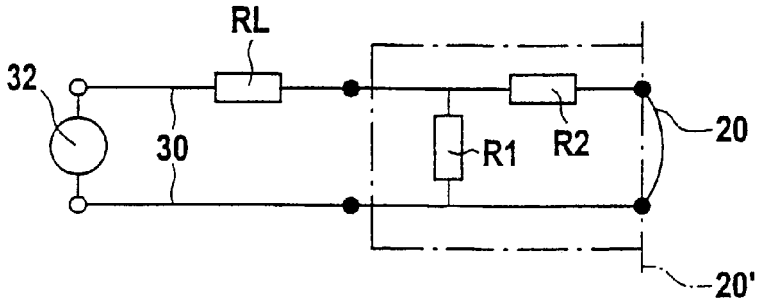
FIG. 9 shows the circuit diagram of FIG. 5 after a short circuit at the shearing point.

FIG. 9 shows a metallic short circuit of the exposed electrical conductors at the separation point 20'. In this case, the evaluation unit 32 measures a resistance Re=RL+[R1*R2/(R1+R2)]. The state "short circuit at the separation point" is allocated to this resistance value.

In the case of use in salt water, a short circuit (or a low transition resistance) will occur after the detachment of the detector head 24 at the separation point 20' as a result of the salt water. However, it should be noted that in this case, it is still possible to distinguish the state "short circuit at the separation point" from the state "detector has been correctly sheared". To this end, the electrical conductors, which connect the terminating resistor R3 in the detector head 24 and the resistance circuitry R1, R2 in the remainder of the detector base 22 are made from a material which under tension in salt water very quickly (i.e., for example, in less than 1 minute) forms an electrically insulating layer. A material of this kind is, for example, copper. As a result of the rapid formation of the electrically insulating layer on the exposed electrical conductors in the salt water, the transition resistance to salt water rapidly increases, so that a short circuit at the separation point can be excluded with certainty after some time, and the correct shearing off of the detector head 24 can be recognised as such.

It remains to be pointed out, that in the circuitries of FIG. 5, resistors R1, R2 and R3 should be selected in such a manner that the predetermined resistance values Ra, Rb, Rc and Rd are sufficiently far apart from each other in order to be distinguished unambiguously from each other. The states "detector is intact", "detector has been correctly sheared", "short circuit in the connecting line", "broken cable", "short circuit at the separation point" are therefore also not allocated to a discrete resistance value, but rather to a resistance range. The states named above are indicated by the evaluation unit 32, if the measured resistance is within a predetermined resistance range.

Figure 10:
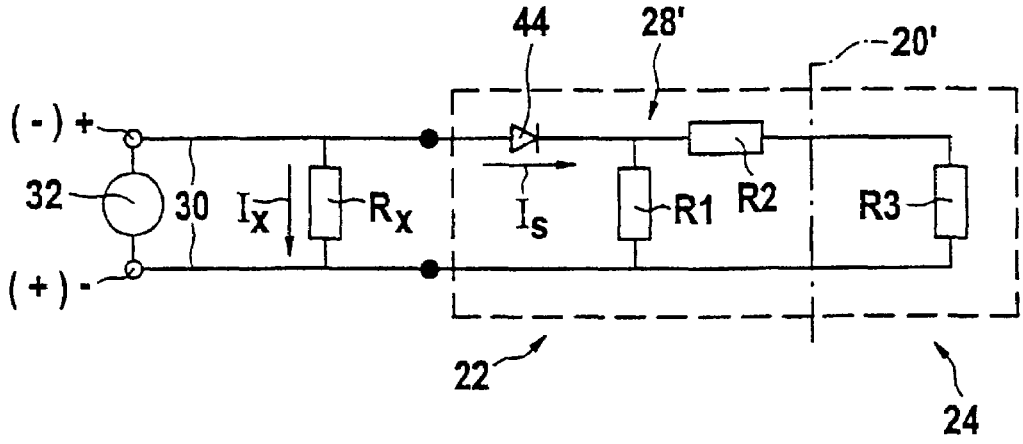
FIG. 10 shows a variant of the circuit diagram of FIG. 5.

FIG. 10 shows the resistance circuitry as in FIG. 5 with an additional diode 44. Rx represents a transition resistance between the two wires of the connecting line 30, which results, e.g., in the case of an insulation fault in the connecting line 30 in a conductive environment. The diode has the effect that current can flow through the resistance circuitry in one direction, but not in the opposite direction. With the polarity shown, the evaluation unit 32 measures the current ls+lx. If the polarity is reversed, the evaluation unit 32 only measures the current lx. The current is can therefore be determined from the difference between the two measurements. An insulation fault in the connecting line 30 does not therefore prevent the determination of the resistance value in the detector circuitry.

Figure 11:
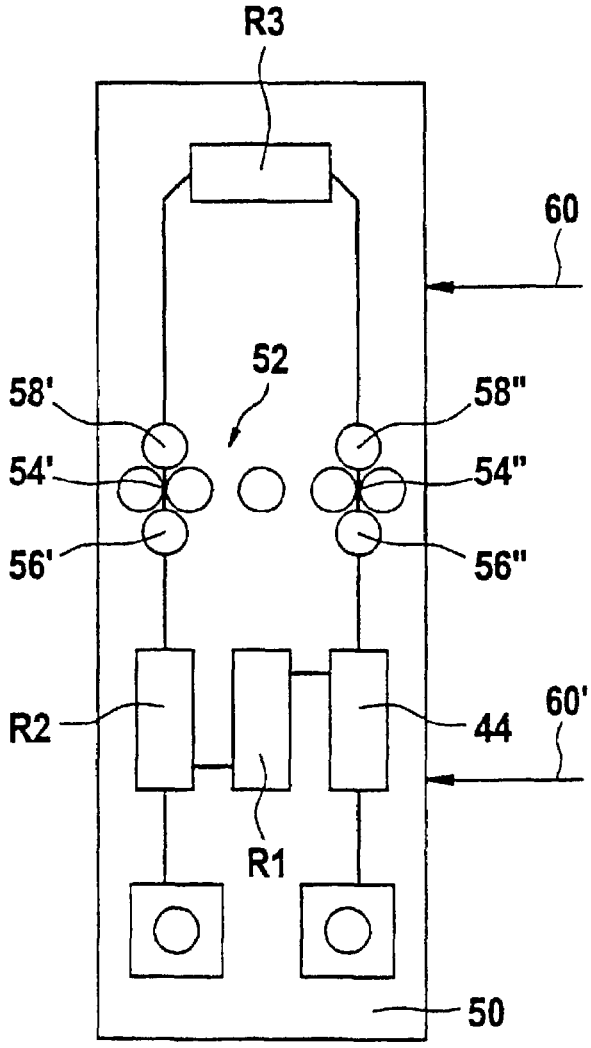
FIG. 11 shows a plan view of a printed circuit board with the circuitry of FIG. 10.

FIG. 11 shows printed circuit board 50 with circuitry as shown. e.g. in FIG. 10. It should be noted that the printed circuit board is subdivided by perforation 52, wherein the terminating resistor R3 is on one side and the remainder of the circuitry is on the other side of the perforation 52. It can be seen that two conductors 54', 54" pass through the bore holes of the perforation 52 in order to connect the terminating resistor R3 to the remainder of the circuitry. On both sides of the perforation 52, the conductors 54', 54" are fixed to the printed circuit board 50 by means of soldering eyelets 56', 58' resp. 56", 58". This fastening ensures that the conductors 54', 54" will break even with small deformations of the printed circuit board 50. The printed circuit board 50 is built into the detector body in such a manner that the perforation 52 is in the region of the predetermined breaking point 20. By means of two arrows 60', 60", FIG. 11 shows the loading on the printed circuit board 50 at the time of shearing of the detector 18. It should be noted in this context that the high-edged arrangement of the printed circuit board 50 within the detector 18 also favours the correct breaking of the conductors 54', 54".

What is claimed is:

1. A device for controlling correct hooking of two sheet pile locks, wherein the first lock comprises a locking chamber into which a complementary lock part of said second lock penetrates, comprising:

a detector arranged in said locking chamber of said first lock in such a manner that when the two locks are correctly hooked, said complementary lock part of said second lock shears said detector; and an electric circuit for determining that said detector has been sheared, comprising a circuitry, which presents a first impedance value prior to said shearing of said detector and a second impedance value after said shearing of said detector, wherein the two impedance values differ substantially from the impedance value of a short circuit respectively of an interruption of said electric circuit outside of said circuitry.

2. The device as claimed in claim 1, wherein:

said detector comprises one end made from a ferro-magnetic material which is arranged in said locking chamber of said first lock in such a manner that when said two locks are correctly hooked, it is detached from the remainder of said detector by the complementary lock part of the second lock, and the circuitry in the remainder of the detector comprises an inductive switch element of which the inductivity is altered by the detachment of the ferro-magnetic end.

3. The device as claimed in claim 1, wherein:

said detector comprises one end with a permanent magnet, which is arranged in the locking chamber of said first lock, in such a manner that when said two locks are correctly hooked, it is sheared off from the remainder of the detector by the complementary lock part of said second lock, and said electric circuit in the remainder of the detector comprises circuitry which responds to a change in the magnetic field which is caused by the shearing off of the permanent magnet.

4. The device as claimed in claim 3, wherein said circuitry that responds to the change in the magnetic field comprises a magnetically actuated microswitch with parallel resistor and series resistor.

5. The device as claimed in claim 4, wherein said terminating resistor in said detachable end of said detector and said resistor circuitry in said remainder of said detector are connected to one another via two electrical conductors which form an electrical insulation layer relatively quickly in salt water.

6. The device as claimed in claim 1, wherein:

said detector comprises one end which is arranged in said locking chamber of the first lock in such a manner that when the two locks are correctly hooked, it is sheared off from the remainder of the detector by the complementary lock part of said second lock, and said electric circuit comprises a resistor circuitry which comprises a terminating resistor in the end to be sheared off of said detector.

7. The device as claimed in claim 6, wherein:

said resistor circuitry in the remainder of said detector comprises a first resistor and a second resistor, wherein said second resistor is connected in series to said terminating resistor and said first resistor is connected in parallel to the series circuit of terminating resistor and second resistor.

8. The device as claimed in claim 6, further comprising a diode connected directly in series to said resistor circuit in such a manner that a direct current can flow through said resistor circuitry only in one direction.

9. The device as claimed in claim 6, wherein:

said resistor circuitry is arranged on a printed circuit board which is subdivided by a perforation, the terminating resistor is located on the one side and the remainder of the circuitry is located on the other side of the perforation, and two conductors lead between said bores of said perforation connecting said terminating resistor to the remainder of the circuitry.

10. The device as claimed in claim 9, wherein said two conductors are fixed to said printed circuit board on both sides of said perforation by soldering eyelets.

11. The device as claimed in claim 10, wherein said electric circuit of the detector comprises an electrical connecting lead and said evaluation unit comprises at least displays for the following states:

a) detector is OK b) detector has been sheared c) connecting lead has been interrupted; and d) short circuit in the connecting lead.

12. The device as claimed in claim 11, wherein said evaluation unit comprises additional displays for the following states:

e) short circuit at the separation point of the detector; and f) measured resistance is unstable.

13. The device as claimed in claim 1, further comprising an evaluation unit which continuously measures at least one electrical parameter of the electric circuit and displays different states on the basis of the measured values.

14. The device as claimed in claim 11, wherein said electric curcuit of the detector comprises an electrical connecting lead and said evaluation unit comprises at least displays for the following states:

a) detector is OK b) detector has been sheared c) connecting lead has been interrupted; and d) short circuit in the connecting lead.

15. The device as claimed in claim 13, wherein said evaluation unit measures the resistance value of the circuit and, after the occurrence of a change in resistance, checks this with reference to stability during a predetermined time.

16. The device as claimed in claim 1, wherein said detector comprises a body which is subdivided by a predetermined breaking point into a detector base and a detector head, wherein said detector base is attached to said first lock and said detector head projects in an cantilevered manner into said locking chamber of said first lock.

* * * * *

UNITED STATES PATENT AND TRADEMARK OFFICE

CERTIFICATE OF CORRECTION

PATENT NO. : 7,015,813 B1
APPLICATION NO. : 10/030607
DATED : March 21, 2006
INVENTOR(S) : Peter Loster It is certified that error appears in the above-identified patent and that said Letters Patent is hereby corrected as shown below:

Title Page, item (73) Assignee should read:
Change "Ar Celor RPS Sarl" to --Arcelor RPS Sarl--

Signed and Sealed this

Fourteenth Day of November, 2006

JON W. DUDAS
*Director of the United States Patent and Trademark Office*